US009640345B2

(12) United States Patent
Kim et al.

(10) Patent No.: US 9,640,345 B2
(45) Date of Patent: May 2, 2017

(54) ELECTRONIC DEVICE HAVING INPUT BUTTON

(71) Applicant: Samsung Electronics Co., Ltd., Gyeonggi-do (KR)

(72) Inventors: Cheol Hee Kim, Seoul (KR); Ji Hoon Kim, Incheon (KR)

(73) Assignee: Samsung Electronics Co., Ltd (KR)

( * ) Notice: Subject to any disclaimer, the term of this patent is extended or adjusted under 35 U.S.C. 154(b) by 20 days.

(21) Appl. No.: 14/671,150

(22) Filed: Mar. 27, 2015

(65) Prior Publication Data

US 2015/0279590 A1 Oct. 1, 2015

(30) Foreign Application Priority Data

Mar. 27, 2014 (KR) ..... 10-2014-0036131

(51) Int. Cl.
*H01H 1/10* (2006.01)
*H01H 13/14* (2006.01)

(52) U.S. Cl.
CPC ..... *H01H 13/14* (2013.01); *H01H 2215/006* (2013.01)

(58) Field of Classification Search
CPC .. H01H 13/807; H01H 13/48; H01H 2215/00; H01H 2209/004; H01H 2209/00
USPC ..... 200/511, 513, 517, 314; 345/168, 169
See application file for complete search history.

(56) References Cited

U.S. PATENT DOCUMENTS 5,343,008 A * 8/1994 Ipcinski ..... H01H 13/06 200/302.2
6,642,920 B2 11/2003 Osawa et al.
7,217,893 B1 * 5/2007 Huang ..... H01H 13/48 200/1 B
8,071,897 B2 * 12/2011 Chiu ..... H01H 13/807 200/5 A
8,735,747 B2 * 5/2014 Bigand ..... H01H 13/64 200/1 B
2001/0033270 A1 10/2001 Osawa et al.

FOREIGN PATENT DOCUMENTS

KR 10-2001-0091015 10/2001
KR 10-0933987 12/2009
KR 10-2013-0128312 11/2013

* cited by examiner

*Primary Examiner* — Vanessa Girardi
(74) *Attorney, Agent, or Firm* — The Farrell Law Firm, P.C.

(57) ABSTRACT

An electronic device is provided. The electronic device includes a housing; an input button inserted into a button hole formed at the housing and disposed to allow a state change, a dome switch having a dome part and disposed to be spaced apart from the input button, a flexible member interposed between the input button and the dome switch and disposed to be pressed in a direction of the dome part by a state change of the input button, and a rigid member interposed between the dome part and the flexible member to deliver the state change of the input button delivered through the flexible member to the dome part.

15 Claims, 4 Drawing Sheets

ELECTRONIC DEVICE HAVING INPUT BUTTON

PRIORITY

This application claims priority under 35 U.S.C. §119(a) to Korean Patent Application No. 10-2014-0036131, filed on Mar. 27, 2014, in the Korean Intellectual Property Office, the entire disclosure of which is incorporated herein by reference.

BACKGROUND

1. Field of the Invention

The present invention relates generally to an electronic device having an input button.

2. Description of the Related Art

For the purpose of turning on and off, or controlling a predetermined function, an input button, such as a button, a switch, and a key may be installed on the housing of a portable electronic device. For example, various function keys and a home button may be installed on the housing.

Such an input button interoperates with a dome switch disposed inside the housing. That is, as an input button is pressed and a dome switch is pressed by the input button, a signal notifying that the dome switch is pressed is input to a control unit installed in an electronic device to generate specific command data. Then, by this command data, a specific function of the electronic device may be controlled.

In order to prevent the short circuit or performance deterioration of a dome switch or other components installed in an electronic device as water or moisture permeates through gaps between an input button or a housing, a flexible member formed of silicon may be installed between the input button and the dome switch.

Moreover, since the flexible member is formed of a material having a shape which is changed by a compressive force, some of the force applied to an input button as the input button is pressed is used to elastically deform the flexible member and only the remaining force is used for the displacement of the flexible member.

Accordingly, when the flexible member is displaced by a predetermined interval by pressing the input button, the displacement of the flexible member becomes less than the displacement of the input button. As a result, only when the input button is pressed relatively deep, a dome switch is linked to the input button and pressed. This may cause a user of the electronic device to experience an unsatisfactory feeling when clicking the input button.

A dome switch may have a dome part protruding convexly toward the input button. When the input button is pressed, a compressive force is applied to the flexible material being interposed between the input button and the dome part.

Since the dome part has a convex form, a contact area of the dome part and the flexible member is small and due to this, an intensive compressive force is applied to the flexible member by the surface of the dome part.

For this reason, when the input button is pressed several times, the flexible member may be damaged, for example, it may crack or tear. Due to this, the waterproof performance of an electronic device may be deteriorated.

SUMMARY

The present invention has been made to address at least the problems and disadvantages described above, and to provide at least the advantages described below.

Accordingly, an aspect of the present invention is to provide an electronic device which improves the feeling of clicking an input button of the electronic device and the life of the flexible member.

In accordance with an aspect of the present invention, an electronic device is provided. The electronic device includes a housing; an input button inserted into a button hole formed at the housing and disposed to allow a state change, a dome switch having a dome part and disposed to be spaced apart from the input button, a flexible member interposed between the input button and the dome switch and disposed to be pressed in a direction of the dome part by a state change of the input button, and a rigid member interposed between the dome part and the flexible member to deliver the state change of the input button delivered through the flexible member to the dome part.

In accordance with another aspect of the present invention, an electronic device is provided. The electronic device includes a housing, an input button inserted into a button hole formed at the housing and disposed to allow a state change, a dome switch having a dome part and disposed to be spaced apart from the input button, a rigid member interposed between the input button and the dome switch and disposed to be pressed in a direction of the dome part by a state change of the input button, and a flexible member formed integrally and continuously at a top of the rigid member, where an area where the rigid member and the flexible member are formed continuously is greater than an area where the rigid member and the dome part contact.

BRIEF DESCRIPTION OF THE DRAWINGS

The above and other aspects, features, and advantages of the present invention will be more apparent from the following detailed description taken in conjunction with the accompanying drawings, in which.

DETAILED DESCRIPTION OF EMBODIMENTS OF THE PRESENT INVENTION

Figure 1A:
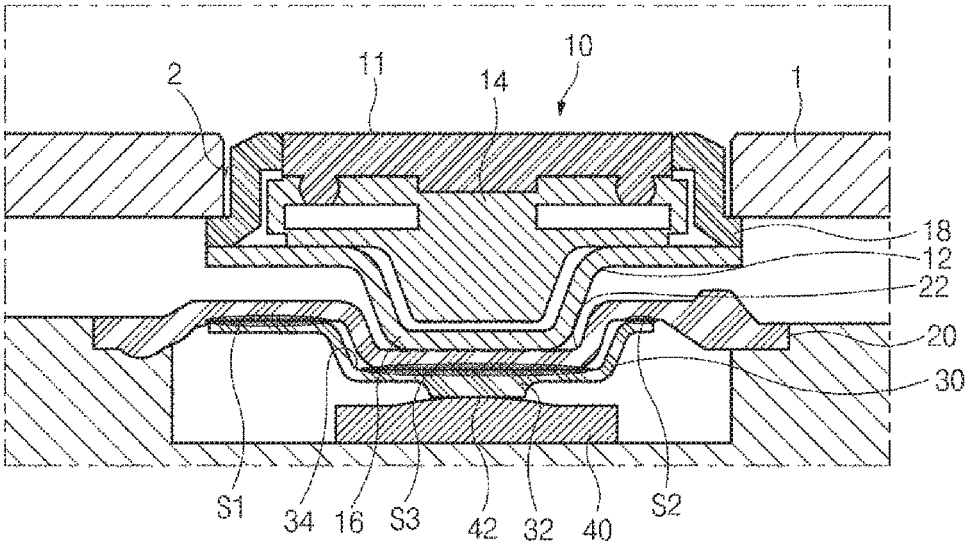
FIG. 1A is a cross-sectional view of an input button of an electronic device, according to an embodiment of the present invention.

Hereinafter, the present invention is described with reference to the accompanying drawings. Various modifications are possible in various embodiments of the present invention and specific embodiments are illustrated in drawings and related detailed descriptions are listed. Thus, it is intended that the present invention covers modifications and variations within the scope of the appended claims and their equivalents. With respect to the descriptions of the drawings, like reference numerals refer to like elements.

The term "include," "comprise," and "have", or "may include," or "may comprise" and "may have" used herein indicates disclosed functions, operations, or existence of elements but does not exclude other functions, operations or elements. Additionally, in this specification, the meaning of "include," "comprise," "including," or "comprising," specifies a property, a region, a fixed number, a step, a process, an element and/or a component but does not exclude other properties, regions, fixed numbers, steps, processes, elements and/or components.

The meaning of the term "or" used herein includes any or all combinations of the words connected by the term "or". For instance, the expression "A or B" may indicate include A, B, or both A and B.

The terms such as "1st", "2nd", "first", "second", and the like used herein may refer to modifying various different elements of various embodiments, but do not limit the elements. For instance, such terms do not limit the order and/or priority of the elements. Furthermore, such terms may be used to distinguish one element from another element. For instance, both "a first user device" and "a second user device" indicate a user device but indicate different user devices from each other. For example, a first component may be referred to as a second component and vice versa without departing from the scope of the present invention.

In this disclosure below, when one part (or element, device, etc.) is referred to as being 'connected' to another part (or element, device, etc.), it should be understood that the former can be 'directly connected' to the latter, or 'electrically connected' to the latter via an intervening part (or element, device, etc.). In contrast, when an element is referred to as being "directly connected" or "directly coupled" to another element, there are no intervening elements present.

Terms used in this specification are used to describe specific embodiments, and are not intended to limit the scope of the present invention. The terms of a singular form may include plural forms unless they have a clearly different meaning in the context.

Unless otherwise defined herein, all the terms used herein, which include technical or scientific terms, may have the same meaning that is generally understood by a person skilled in the art. It will be further understood that terms, which are defined in the dictionary and are commonly used, should also be interpreted as is customary in the relevant related art and not in an idealized or overly formal sense unless expressly so defined herein in various embodiments of the present invention.

An electronic device according to various embodiments of the present invention may have a communication function. For instance, electronic devices may include at least one of smartphones, tablet Personal Computers (PCs), mobile phones, video phones, electronic book (e-book) readers, desktop PCs, laptop PCs, netbook computers, Personal Digital Assistants (PDAs), Portable Multimedia Players (PMPs), MP3 players, mobile medical devices, cameras, and wearable devices (e.g., Head-Mounted-Devices (HMDs), such as electronic glasses, electronic apparel, electronic bracelets, electronic necklaces, electronic accessories, electronic tattoos, and smart watches).

According to some embodiments, an electronic device may be a smart home appliance. The smart home appliances may include at least one of, for example, televisions, DVD players, audios, refrigerators, air conditioners, cleaners, ovens, microwave ovens, washing machines, air cleaners, set-top boxes, TV boxes (e.g., Samsung HomeSync™, Apple TV™ or Google TV™), game consoles, electronic dictionaries, electronic keys, camcorders, and electronic picture frames.

According to embodiments of the present invention, an electronic device may include at least one of various medical devices (for example, Magnetic Resonance Angiography (MRA) devices, Magnetic Resonance Imaging (MRI) devices, Computed Tomography (CT) devices, medical imaging devices, ultrasonic devices, etc.), navigation devices, Global Positioning System (GPS) receivers, Event Data Recorders (EDRs), Flight Data Recorders (FDRs), vehicle infotainment devices, marine electronic equipment (for example, marine navigation systems, gyro compasses, etc.), avionics, security equipment, car head units, industrial or household robots, Automatic Teller's Machines (ATMs), and Point Of Sale (POS) systems.

According to an embodiment of the present invention, an electronic device may include at least one of furniture or buildings/structures, electronic boards, electronic signature receiving devices, projectors, or various measuring instruments (for example, water, electricity, gas, or radio signal measuring instruments). An electronic device according to an embodiment of the present invention may be one of the above-mentioned various devices or a combination thereof. Additionally, an electronic device according to an embodiment of the present invention may be a flexible device. Furthermore, it is apparent to those skilled in the art that an electronic device according to an embodiment of the present invention is not limited to the above-mentioned devices.

Hereinafter, a waterproof structure of an electronic device and a method of manufacturing the same according to various embodiments of the present invention will be described in more detail with reference to the accompanying drawings. The term "user" in various embodiments may refer to a person using an electronic device or to a device using an electronic device (for example, an artificial intelligence electronic device).

Figure 1B:
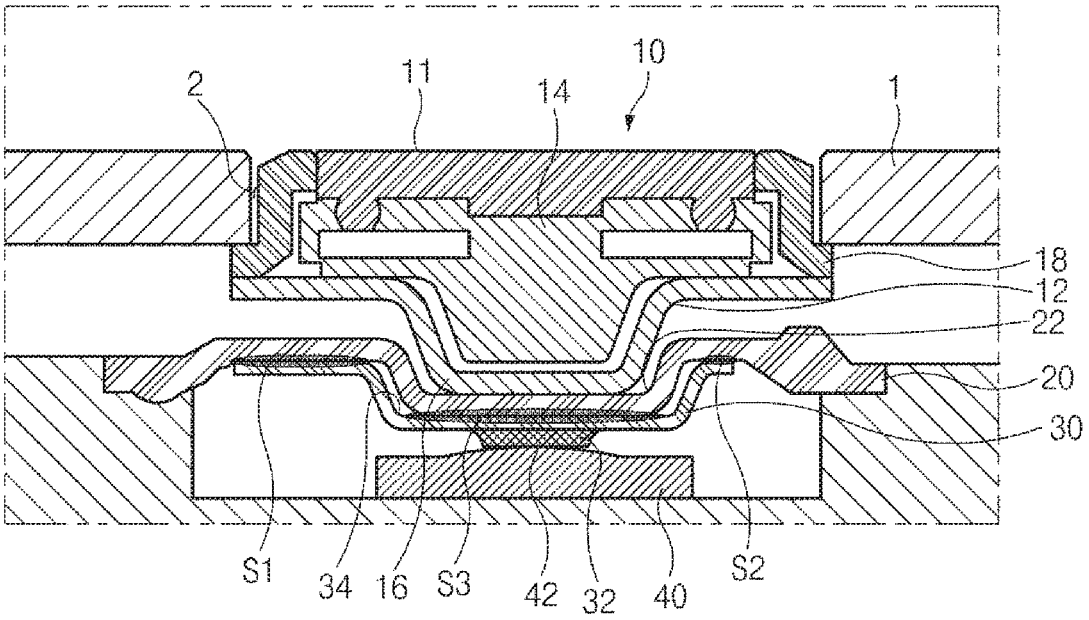
FIG. 1B is a cross-sectional view of an input button of an electronic device with a click protrusion having a different material from a material of a rigid member, according to an embodiment of the present invention.
Figure 2:
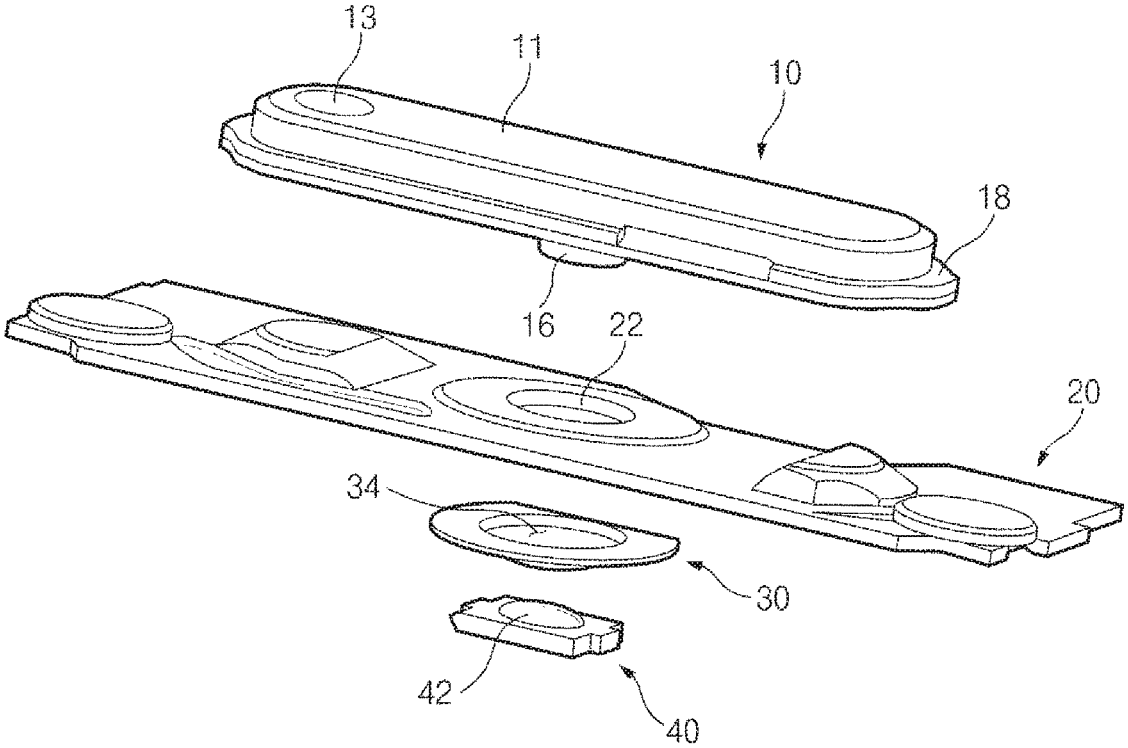
FIG. 2 is a perspective view of an input button and various components thereof, according to an embodiment of the present invention.

FIG. 1A is a cross-sectional view of an input button of an electronic device, according to an embodiment of the present invention. FIG. 1B is a cross-sectional view of an input button of an electronic device with a click protrusion having a different material from a material of a rigid member, according to an embodiment of the present invention. FIG. 2 is a perspective view of an input button and various components thereof, according to an embodiment of the present invention.

Referring to FIGS. 1A, 1B, and 2, an electronic device according to an embodiment of the present invention includes a housing 1, an input button 10 inserted into a button hole 2 at the housing 1 and pressed (or mounted at a button hole to move vertically or disposed to allow a change in state (for example, form or position)), a dome switch 40 having a dome part 42 to be pressed and disposed at the housing 1 while being spaced apart from the input button 10, a flexible member 20 interposed between the input button 10 and the dome switch 40, and a rigid member 30 interposed between the dome part 42 and the flexible member 20.

The button hole 2 formed at the housing 1 is a through hole into which various input buttons such as function keys or a home button are inserted.

A hook projection 18 is formed in at least a partial area of the edge of the input button 10 in order to prevent the input button 10 from being separated from the button hole 2.

Although it is shown that the hook projection 18 roughly forms a right angle roughly, the edge portion of the hook projection 18 may be processed to be rounded.

Additionally, as shown in FIGS. 1A and 1B, when the hook projection 18 roughly forms a right angle, the input button 10 is inserted from the inside of the button hole 2 toward the outside. Moreover, unlike FIGS. 1A and 1B, when the hook projection 18 has a wedge-shaped section narrowing from the outside of the button hole 2 toward the inside, the input button 10 is inserted from the outside of the button hole 2 toward the inside.

The input button 10 includes a typical plate-shaped or bulk-shaped member formed of a material such as plastic. However, the input button 10 may have a function more than a simple press button. For example, a semiconductor device 13 may be mounted in at least a partial area of an outer end part 11 of the input button 10. Through this semiconductor device 13, current, stimulus, or information may be delivered to a processor of an electronic device. For example, this semiconductor device 13 may be used for fingerprint recognition.

An inner end part 12 of the input button 10 may be formed of a metallic material or a polycarbonate material and also may be formed of a plastic material having a rigidity comparable to polycarbonate.

Between the outer end part 11 and the inner end part 12 of the input button 10, a molding 14 filling at least a portion of a space between the outer end part 11 and the inner end part 12 is formed. When a semiconductor device 13 is mounted in at least a partial area of the outer end part 11 of the input button 10, a wire or a signal line may be disposed in the molding 14 together. In some cases, the molding 14 may be omitted.

A protrusion piece 16 protruding toward the flexible member 20 is formed at the side of the flexible member 20 of the input button 10.

The flexible member 20 is pressed toward the dome part 42 by pressing the input button 10 and the rigid member 30 delivers the press operation of the input button 10 to the dome part 42.

That is, the press operation of the input button 10 is delivered to the dome part 42 through the flexible member 20 and the rigid member 30.

The area of a contact side S1 and a contact side S2 of the flexible member 20 is greater longer than the area of a side that the rigid member 30 contacts. The area of a contact side S3 of the rigid member 30 is greater than the area of a side that the dome part 42 contacts.

Even when a press force toward the dome part 42 is applied to the rigid member 30 by pressing the input button 10, unlike the flexible member 20, the surface of the rigid member 30 is not recessed by the dome part 42 and the form change of the rigid member 30 by the dome switch 40 is negligible.

Accordingly, the force applied to the flexible member 20 by the input button 10 is distributed and applied to the rigid member 30 through the contact side S1 and the contact side S2 of the flexible member 20 and through the contact side S3 of the rigid member 30, regardless of the surface form or surface area of the dome part 42.

For example, even when the input button 10 presses the flexible member 20, the flexible member 20 is supported only by the rigid member 30 and is not recessed by the surface of the dome switch 40. Therefore, compared to the conventional art, the elastic deformation of the flexible member 20 is reduced.

In such a way, when an area that the rigid member 30 and the flexible member 20 contact is greater than an area that the rigid member 30 and the dome part 42 contact, the elastic deformation of the flexible member 20 is reduced. Therefore, most of the displacement of the input button 10 is converted into the displacement of the flexible member 20 and as a result, even when the input button 10 is not pressed excessively, the dome part 42 is clicked. Accordingly, the feeling when clicking the input button 10, installed on an electronic device, is improved.

Additionally, since the rigid member 30 delivers the press operation of the input button 10 to the dome part 42 while the rigid member 30 is interposed between the dome part 42 and the flexible member 20 to block the direct contact between the dome part 42 and the flexible member 20, as mentioned above, the flexible member 20 is not deformed and recessed by the dome part 42. As a result, an intensive compressive force by the dome part 42 is not applied to a specific portion of the flexible member 20. Therefore, the damage of the flexible member 20, for example, by crack or tearing, is reduced.

When the potential for damage of the flexible member 20 decreases, the service life of the flexible member 20 increases, and the long-term waterproof performance of an electronic device is realized.

Moreover, when a weight applied to the dome part 42 is applied to the center of the dome part 42 intensively, the dome part 42 is clicked securely. In consideration of this point, the rigid member 30 may have a click protrusion 32 protruding from the side facing the dome part 42 toward the center of the dome part 42.

The width of the click protrusion 32 is formed narrower than the width of the dome part 42. In this case, since a weight is intensively applied to the center of the dome part 42, the dome part 42 is deformed easily with a little click of the input button 10. As a result, the feeling when clicking the input button 10 may be further improved.

The click protrusion 32 may be formed integrally with the same material as the rigid member 30 but may be formed of a different material than the rigid member 30. For example, the clock protrusion 32 may be formed of Ultra Violet (UV) plastic cured by being exposed to UV. However, in order to sufficiently deliver the displacement occurring when the input button 10 is pressed to the dome part 42 through the click protrusion 32, the click protrusion 32 may be formed of a more rigid material than the flexible member 20.

In the embodiment shown in FIGS. 1A and 1B, a protrusion piece 16 is formed at the inner end part 12 of the input button 10. At this point, the protrusion piece 16 is formed broader than the surface area of the dome part 42. In this case, even when the input button 10 is pressed, since the protrusion piece 16 does not apply an intensive weight to a specific portion of the flexible member 20, the flexible member 20 is prevented from being damaged by the protrusion piece 16.

As shown in FIGS. 1A and 1B, the flexible member 20 has a protrusion piece receiving part 22 receiving the protrusion piece 16 and the rigid member 30 have a flexible member receiving groove 34 receiving the protrusion piece receiving part 22. Through this, a mutual positional relationship between the input button 10, the flexible member 20, and the rigid member 30 does not change and is maintained to be relatively constant and stable.

Although it is shown in FIGS. 1A and 1B that the protrusion piece 16 is formed at the inner end part 12 of the input button 10, a modified embodiment in which the inner end part 12 of the input button 10 has a flat form without the protrusion piece 16 and the flat inner end part 12 contacts the flexible member 20 may be realized.

The rigid member 30 may be formed of the same material as the inner end part 12 of the input button 10, as shown in FIG. 1A, or may be formed of a material having a higher elasticity than that of the inner end part 12 of the input button 10, as shown in FIG. 1B. However, the rigid member 30 may have a lower elasticity than the flexible member 20. In this case, the most deformable member among the input button 10, the flexible member 20, and the rigid member 30 is the flexible member 20. As mentioned above, since the flexible member 20 has less elastic deformation compared to the conventional art, the displacement of the input button 10 is sufficiently delivered to the dome part 42.

Figure 3:
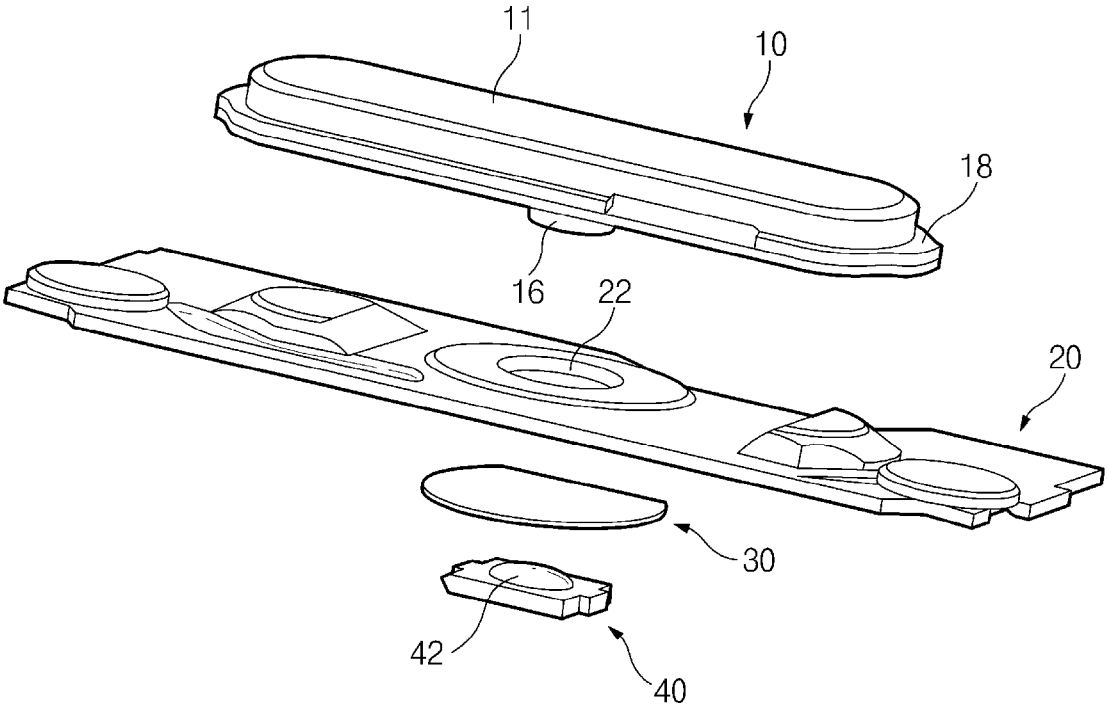
FIG. 3 is a perspective view of an input button and various components thereof, according to another embodiment of the present invention.

FIG. 3 is a perspective view of an input button and various components thereof, according to another embodiment of the present invention.

Referring to FIG. 3, in contrast to the embodiment shown in FIGS. 1A, 1B, and 2, the rigid member 30 does not have the flexible member receiving groove 34. Thus, even when the flexible member receiving groove 34 is not formed at the rigid member 30, as long as a position is maintained stably in the housing 1 of the rigid member 30, the rigid member 30 presses the dome part 42 sufficiently.

Although a structure in which the rigid member 30 and the flexible member 20 are stacked separately is shown in FIGS. 1A, 1B, 2, and 3, the rigid member 30 and the flexible member 20 may have an integrated structure. For example, the rigid member 30 may have an integrally molded structure through insert injection to the flexible member 20. In this case, since the relative position of the rigid member 30 and the flexible member 20 does not change, an additional structure for maintaining the position of the rigid member 30 stably is not required.

Accordingly, an electronic device according to an embodiment of the present invention includes a rigid member interposed between an input button and the dome switch and pressed in a direction of the dome part by a state change of the input button and a flexible member integrally and continuously formed at the top of the rigid member. An area where the rigid member and the flexible member are formed continuously is formed greater than an area where the rigid member and the dome part contact.

Figure 4:
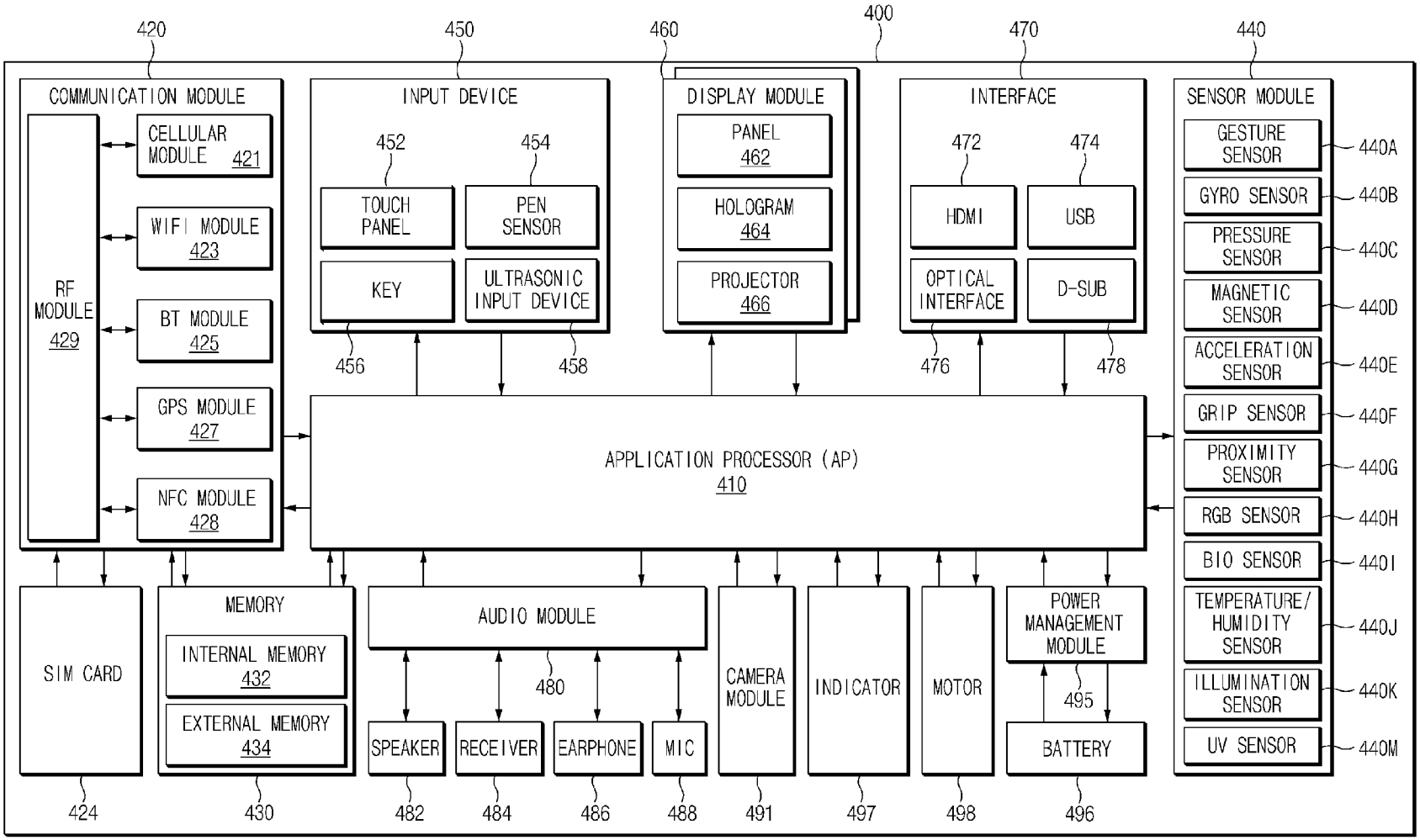
FIG. 4 is a block diagram illustrating an electronic device, according to an embodiment of the present invention.

FIG. 4 is a block diagram illustrating an electronic device, according to an embodiment of the present invention.

Referring to FIG. 4, the electronic device 400, for example, may configure all or part of the above-mentioned electronic device.

Referring to FIG. 4, the electronic device 400 includes at least one Application Processor (AP) 410, a communication module 420, a Subscriber Identification Module (SIM) card 424, a memory 430, a sensor module 440, an input device 450, a display 460, an interface 470, an audio module 480, a camera module 491, a power management module 495, a battery 496, an indicator 497, and a motor 498.

The AP 410 controls a plurality of hardware or software components connected to the AP 410 and also performs various data processing and operations with multimedia data by executing an operating system or an application program. The AP 410 may be implemented with a System on Chip (SoC), for example. According to an embodiment of the present invention, the processor 410 may further include a Graphic Processing Unit (GPU).

The communication module 420 performs data transmission between the electronic device 400 and other electronic devices connected thereto through a network. The communication module 420 includes a cellular module 421, a WiFi module 423, a Bluetooth (BT) module 425, a GPS module 427, an Near Field Communication (NFC) module 428, and a Radio Frequency (RF) module 429.

The cellular module 421 provides voice calls, video calls, text services, or internet services through a communication network (for example, Long Term Evolution (LTE), LTE-Advanced (LTE-A), Code Division Multiple Access (CDMA), Wideband Code Division Multiple Access (WCDMA), Universal Mobile Telecommunication System (UMTS), Wireless Broadband (WiBro), or Global System for Mobile Communications (GSM). The cellular module 421 performs a distinction and authentication operation on an electronic device in a communication network by using the SIM card 424, for example. The cellular module 421 may perform at least part of a function that the AP 410 provides. For example, the cellular module 421 may perform at least part of a multimedia control function.

The cellular module 421 may further include a Communication Processor (CP). Additionally, the cellular module 421 may be implemented with SoC, for example.

The AP 410 or the cellular module 421 (for example, a CP) may load instructions or data, which are received from a nonvolatile memory or at least one of other components connected thereto, into a volatile memory and then process them. Furthermore, the AP 410 or the cellular module 421 may store data received from or generated by at least one of other components in a nonvolatile memory.

Each of the WiFi module 423, the BT module 425, the GPS module 427, and the NFC module 428 may include a processor for processing data transmitted/received through a corresponding module.

At least part (for example, more than two) of the cellular module 421, the WiFi module 423, the BT module 425, the GPS module 427, or the NFC module 428 may be included in one Integrated Chip (IC) or an IC package. For example, at least some (for example, a CP corresponding to the cellular module 421 and a WiFi processor corresponding to the WiFi module 423) of the cellular module 421, the WiFi module 423, the BT module 425, the GPS module 427, and the NFC module 428 may be implemented with one SoC.

The RF module 429 is responsible for data transmission, for example, the transmission of an RF signal. The RF module 429 may include a transceiver, a Power Amp Module (PAM), a frequency filter, or a Low Noise Amplifier (LNA). Additionally, the RF module 429 may further include components for transmitting/receiving electromagnetic waves on a free space in a wireless communication, for example, conductors or conducting wires.

At least one of the cellular module 421, the WiFi module 423, the BT module 425, the GPS module 427, or the NFC module 428 may perform RF signal transmission through an additional RF module.

The SIM card 424 is inserted into a slot formed at a specific position of the electronic device 400. The SIM card 424 includes unique identification information (for example, an Integrated Circuit Card Identifier (ICCID)) or subscriber information (for example, an International Mobile Subscriber Identity (IMSI)).

The memory 430 includes an internal memory 432 or an external memory 434. The internal memory 432 includes at least one of a volatile memory (for example, Dynamic Random Access Memory (DRAM), Static RAM (SRAM), Synchronous Dynamic RAM (SDRAM)) and a non-volatile memory (for example, One Time programmable Read Only Memory (OTPROM), Programmable ROM (PROM), Erasable and Programmable ROM (EPROM), Electrically Erasable and Programmable ROM (EEPROM), mask ROM, flash ROM, NAND flash memory, and NOR flash memory).

The internal memory 432 may be a Solid State Drive (SSD). The external memory 434 may further include a flash drive, for example, a Compact Flash (CF) drive, a Secure Digital (SD) drive, a Micro-SD (Micro-SD) drive, a mini-SD (Mini-SD) drive, an extreme Digital (xD) drive, or a memory stick drive. The external memory 434 may be functionally connected to the electronic device 400 through various interfaces. According to an embodiment of the present invention, the electronic device 400 may further include a storage device (or a storage medium) such as a hard drive.

The sensor module 440 measures physical quantities or detects an operating state of the electronic device 400, thereby converting the measured or detected information into electrical signals. The sensor module 440 includes at least one of a gesture sensor 440A, a gyro sensor 440B, a pressure sensor 440C, a magnetic sensor 440D, an acceleration sensor 440E, a grip sensor 440F, a proximity sensor 440G, a color sensor 440H (for example, a Red, Green, Blue (RGB) sensor), a bio sensor 440I, a temperature/humidity sensor 440J, an illumination sensor 440K, and an UV sensor 440M. Additionally/alternately, the sensor module 440 include an E-nose sensor, an electromyography (EMG) sensor, an electroencephalogram (EEG) sensor, an electrocardiogram (ECG) sensor, an infrared (IR) sensor, an iris sensor, or a fingerprint sensor. The sensor module 440 further includes a control circuit for controlling at least one sensor therein.

The input module 450 includes a touch panel 452, a (digital) pen sensor 454, a key 456, or an ultrasonic input device 458. The touch panel 452 recognizes a touch input through at least one of capacitive, resistive, IR, or ultrasonic methods, for example. Additionally, the touch panel 452 may further include a control circuit. In the case of the capacitive method, both direct touch and proximity recognition are possible. The touch panel 452 may further include a tactile layer. In this case, the touch panel 452 may provide a tactile response to a user.

The (digital) pen sensor 454 may be implemented through a method similar or identical to that of receiving a user's touch input or an additional sheet for recognition. The key 456 may include a physical button, a touch key, an optical key, or a keypad, for example. The ultrasonic input device 458, a device which checks data by detecting sound waves through a microphone (for example, the MIC 488) in the electronic device 400, may provide wireless recognition through an input tool generating ultrasonic signals. The electronic device 400 may receive a user input from an external device (for example, a computer or a server) connected to the electronic device 400 through the communication module 420.

The display 460 may include a panel 462, a hologram device 464, or a projector 466. The panel 462, for example, may include a Liquid-Crystal Display (LCD) or an Active-Matrix Organic Light-Emitting Diode (AM-OLED). The panel 462 may be implemented to be flexible, transparent, or wearable, for example. The panel 462 and the touch panel 452 may be configured with one module. The hologram 464 shows three-dimensional images in the air by using the interference of light. The projector 466 displays an image by projecting light on a screen. The screen, for example, may be placed inside or outside the electronic device 400. The display 460 may further include a control circuit for controlling the panel 462, the hologram device 464, or the projector 466.

The interface 470 may include a High-Definition Multimedia Interface (HDMI) 472, a Universal Serial Bus (USB) 474, an optical interface 476, or a D-subminiature (D-sub) 478. The interface 470 includes a Mobile High-definition Link (MHL) interface, a Secure Digital (SD) card/Multi-Media Card (MMC) interface, or an Infrared Data Association (IrDA) standard interface.

The audio module 480 converts sound and electrical signals in both directions. The audio module 480 processes sound information input or output through a speaker 482, a receiver 484, an earphone 486, or a MIC 488.

The camera module 491, a device for capturing a still image and a video, includes at least one image sensor (for example, a front sensor or a rear sensor), a lens, an Image Signal Processor (ISP), or a flash (for example, an LED or a xenon lamp).

The power management module 495 manages the power of the electronic device 400. The power management module 495 may include a Power Management Integrated Circuit (PMIC), a charger Integrated Circuit (IC), or a battery gauge, for example.

The PMIC is built in an IC or SoC semiconductor, for example. A charging method may be classified as a wired method and a wireless method. The charger IC charges a battery and prevents overvoltage or overcurrent flow from a charger. The charger IC includes a charger IC for at least one of a wired charging method and a wireless charging method. As the wireless charging method, for example, there is a magnetic resonance method, a magnetic induction method, or an electromagnetic method. An additional circuit for wireless charging, for example, a circuit such as a coil loop, a resonant circuit, or a rectifier circuit, may be added.

The battery gauge measures the remaining amount of the battery 496, or a voltage, current, or temperature of the battery 496 during charging. The battery 496 stores or generates electricity and supplies power to the electronic device 400 by using the stored or generated electricity. The battery 496, for example, may include a rechargeable battery or a solar battery.

The indicator 497 displays a specific state of the electronic device 400 or part thereof (for example, the AP 410), for example, a booting state, a message state, or a charging state.

The motor 498 converts electrical signals into mechanical vibrations. The electronic device 400 includes a processing device (for example, a GPU) for mobile TV support. A processing device for mobile TV support processes media data according to standards such as Digital Multimedia Broadcasting (DMB), Digital Video Broadcasting (DVB), or media flow.

According to various embodiments of the present invention, since a flexible member does not contact a dome switch directly, an electronic device including the flexible member with a long service life is provided.

Additionally, according to various embodiments of the present invention, since an area where a rigid member and a flexible member contact is relatively broad, most of the displacement of an input button is converted into the displacement of the flexible member. As a result, an electronic device with an improved feeling when clicking the input button is provided.

Each of the above-mentioned components of the electronic device, according to various embodiments of the present invention, may be configured with at least one component and the name of a corresponding component may vary according to the kind of an electronic device. An electronic device may be configured including at least one of the above-mentioned components or additional other components. Additionally, some components of an electronic device may be combined and configured as one entity, so that functions of previous corresponding components are performed identically.

The term "module" used in this disclosure, for example, means a unit including a combination of at least one of hardware, software, and firmware. The term "module" and the term "unit", "logic", "logical block", "component", or "circuit" may be interchangeably used. The term module "module" may refer to a minimum unit or part of an integrally configured component. "module" or may refer to a minimum unit performing at least one function or part thereof. A "module" may be implemented mechanically or electronically. For example, "module" used in this disclosure may include at least one of an Application-Specific Integrated Circuit (ASIC) chip performing certain operations, Field-Programmable Gate Arrays (FPGAs), or a programmable-logic device.

At least part of a device (for example, modules or functions thereof) or a method (for example, operations) according to this disclosure, for example, as in a form of a programming module, may be implemented using an instruction stored in computer-readable storage media. When at least one processor executes an instruction, it may perform a function corresponding to the instruction. At least part of a programming module may include a module, a program, a routine, sets of instructions, or a process to perform at least one function, for example.

The computer-readable storage media may include Magnetic Media such as a hard disk, a floppy disk, and a magnetic tape, Optical Media such as Compact Disc ROM (CD-ROM) and DVD, Magneto-Optical Media such as Floptical Disk, and a hardware device especially configured to store and perform a program instruction (for example, a programming module) such as ROM, RAM, and flash memory. Additionally, a program instruction includes high-level language code executable by a computer using an interpreter in addition to machine code created by a complier. The hardware device is configured to operate as at least one software module to perform an operation.

A module of a programming module includes at least one of the above-mentioned components or additional other components. Or, some programming modules may be omitted. Operations performed by a programming module or other components may be executed through a sequential, parallel, repetitive or heuristic method. Additionally, some operations may be executed in a different order or may be omitted. Or, other operations may be added.

The various embodiments of the present invention provided in this specification are described with the intention to help those skilled in the art to understand the principles and concepts of the present invention, so that it will be understood by those skilled in the art that various changes in form and details may be made therein without departing from the spirit and scope of the invention. Therefore, the disclosed embodiments should be considered in a descriptive sense only, and not in a limited perspective sense. The scope of the invention is defined not by the detailed description of the invention but by the appended claims and their equivalents, and all differences within the scope will be construed as being included in the present invention.

What is claimed is:

1. An electronic device comprising:

a housing;

an input button inserted into a button hole formed at the housing and disposed to allow a state change;

a dome switch having a dome part and disposed to be spaced apart from the input button;

a rigid member interposed between the input button and the dome switch and disposed to be pressed in a direction of the dome part by a state change of the input button; and a flexible member formed integrally and continuously at a top of the rigid member, wherein an area where the rigid member and the flexible member are formed continuously is greater than an area where the rigid member and the dome part contact, wherein a protrusion piece protruding toward the dome switch is formed at a side of the flexible member of the input button, wherein the flexible member comprises a protrusion piece receiving part receiving the protrusion piece, and wherein the rigid member comprises a flexible member receiving groove receiving the protrusion piece receiving part.

2. An electronic device comprising:

a housing;

an input button inserted into a button hole formed at the housing and disposed to allow a state change;

a dome switch having a dome part and disposed to be spaced apart from the input button;

a flexible member interposed between the input button and the dome switch and disposed to be pressed in a direction of the dome part by a state change of the input button; and a rigid member interposed between the dome part and the flexible member to deliver the state change of the input button delivered through the flexible member to the dome part, wherein a protrusion piece protruding toward the dome switch is formed at a side of the flexible member of the input button, wherein the flexible member comprises a protrusion piece receiving part receiving the protrusion piece, and wherein the rigid member comprises a flexible member receiving groove receiving the protrusion piece receiving part.

3. The electronic device of claim 2, wherein a hook projection is formed in at least a partial area of an edge of the input button to prevent the input button from being separated from the button hole.

4. The electronic device of claim 2, wherein a semiconductor device is mounted in at least a partial area of an outer end part of the input button.

5. The electronic device of claim 2, wherein the rigid member and the flexible member comprise an integrated structure.

6. The electronic device of claim 5, wherein the rigid member comprises an integrally molded structure through insert injection to the flexible member.

7. The electronic device of claim 2, wherein an inner end part of the input button is formed of a metallic material or a polycarbonate material.

8. The electronic device of claim 7, wherein a molding filling at least a portion of a space between an outer end part and the inner end part of the input button is formed between the outer end part and the inner end part.

9. The electronic device of claim 7, wherein the rigid member is formed of the same material as the inner end part of the input button or is formed of a material having a higher elasticity than that of the inner end part of the input button, wherein the rigid member comprises a lower elasticity than the flexible member.

10. The electronic device of claim 2, wherein an area where the rigid member and the flexible member contact is greater than an area where the rigid member and the dome part contact.

11. The electronic device of claim 2, wherein the protrusion piece is broader than a surface area of the dome part.

12. The electronic device of claim 10, wherein the rigid member comprises a click protrusion protruding from a side facing the dome part to a center of the dome part.

13. The electronic device of claim 12, wherein a width of the click protrusion is narrower than a width of the dome part.

14. The electronic device of claim 12, wherein the click protrusion is formed of a different material than the rigid member.

15. The electronic device of claim 14, wherein the click protrusion is more rigid than the flexible member.

* * * * *